US008221620B2

(12) United States Patent
Dietrich

(10) Patent No.: US 8,221,620 B2
(45) Date of Patent: Jul. 17, 2012

(54) COLLECTION BAG FOR A SWIMMING POOL VACUUM

(76) Inventor: Dan Dietrich, Boca Raton, FL (US)

( * ) Notice: Subject to any disclaimer, the term of this patent is extended or adjusted under 35 U.S.C. 154(b) by 348 days.

(21) Appl. No.: 12/660,070

(22) Filed: Feb. 20, 2010

(65) Prior Publication Data

US 2011/0203980 A1 Aug. 25, 2011

(51) Int. Cl.
*E04H 4/16* (2006.01)
*B01D 29/27* (2006.01)

(52) U.S. Cl. ..... 210/167.17; 210/232

(58) Field of Classification Search ..... 210/167.17, 210/232, 448; 15/1.7
See application file for complete search history.

(56) References Cited

U.S. PATENT DOCUMENTS 4,856,913 A * 8/1989 Campbell ..... 383/42
4,880,531 A * 11/1989 Blake et al. ..... 210/167.17
D311,796 S * 10/1990 Collins ..... D32/31
6,706,175 B1 * 3/2004 Rief et al. ..... 210/167.17

FOREIGN PATENT DOCUMENTS

WO WO 2006/014746 A1 * 2/2006

* cited by examiner

*Primary Examiner* — Fred Prince
(74) *Attorney, Agent, or Firm* — Robert M. Downey, P.A.

(57) ABSTRACT

A debris collection bag made of a water permeable material is adapted for removable attachment to a self-contained swimming pool vacuum head that uses a motor driven propeller to generate thrust for picking up debris and forcing it into the collection bag. The bag includes a main upper portion that encloses a collection chamber, and a truncated lower portion with an open end. A sleeve between the upper and lower portions surrounds the bag and contains a releasable cinch cord for securing the bag over an annular rim on the vacuum head. The truncated lower portion tucks upwardly within the collection chamber to provide a frustoconical intake that increases thrust pressure entering the bag, while providing greater self cleaning circulation at the top of the collection chamber and a low pressure area surrounding the truncated lower portion to allow leaves, dirt and other debris to settle without escaping the collection chamber.

9 Claims, 4 Drawing Sheets

COLLECTION BAG FOR A SWIMMING POOL VACUUM

BACKGROUND OF THE INVENTION

1. Field of the Invention

The present invention relates to swimming pool vacuums and, more specifically, to a collection bag for removable attachment to a self-contained swimming pool vacuum head; the collection bag being specifically designed to trap the collected debris so that it does not escape back out through the open end when the bag is attached to the vacuum head.

2. Discussion of the Related Art

The ordinary care and maintenance of swimming pools requires regular vacuuming of the pool bottom and sidewalls in order to remove dirt, leaves and other debris. Traditionally, swimming pool vacuum systems have employed the use of an elongate flexible hose which attaches at one end to a vacuum head on a pole and to the pool's skimmer intake at an opposite end of the hose. Circulation of the pool water through the pool's filter system by a pump creates suction at the vacuum head. By maneuvering the vacuum head over the pool surfaces, dirt and other small particles are drawn through the hose and into the filter system. Larger items, such as leaves, sticks, and bugs are trapped in a basket in the filter system. After cleaning, the basket and the pool filter must be cleaned to remove the leaves and debris.

Cleaning swimming pools using the above described pool vacuum system is laborious and time consuming, particularly due to the need to clean the filter and basket after each time the pool is vacuumed. Due to the inefficiency of this type of a system, most commercial pool cleaning services prefer to use self contained submersible vacuum heads that have an electric motor that drives a propeller for creating thrust through the vacuum head, thereby drawing dirt, leaves and other debris up through a bottom mouth of the vacuum head, through a thrust channel and into an attached collection bag. Once the pool has been vacuumed, the vacuum head is lifted and removed from the pool and the collection bag is removed and cleaned. An example of a self-contained swimming pool vacuum head is disclosed in my prior U.S. Pat. No. 5,768,734.

While use of self-contained submersible vacuum heads has proven to be cost effective and highly efficient for commercial pool cleaning services, cleaning the collected dirt and other debris within the attached bag has been problematic. More specifically, the design of collection bags and the manner of attachment of collection bags to self-contained submersible swimming pool vacuum heads relies on the thrust of the motor driven propeller to maintain the debris in the bag. Often, some of the collected debris, and particularly smaller particles, falls out of the bottom open end of the bag and through the vacuum head and back into the pool. This typically happens when the upper portion of the collection chamber of the bag becomes filled with debris which blocks the flow of water upwardly through the collection bag. This can cause a drop in thrust pressure which allows some of the debris to escape out the bottom of the bag.

Accordingly, there remains a definite need for an improved collection bag for removable attachment to existing self-contained submersible swimming pool vacuum heads. More particularly, there remains a need for an improved collection bag that provides for greater thrust pressure through the bag with improved circulation at a top portion of the collection chamber to prevent gathering of collected debris in this area which has the effect of reducing thrust pressure. Moreover, there is a need for improved collection bag that provides for a cone shaped entry port into the bag which has the effect of increasing thrust pressure with greater circulation at an upper portion of the bag and lower pressure surrounding the cone shaped entry portion at a lower portion of the collection chamber to thereby allow debris to settle in the lower portion of the collection chamber without escaping the bag opening.

OBJECTS AND ADVANTAGES OF THE INVENTION

Considering the foregoing, it is a primary object of the present invention to provide an improved collection bag for removable attachment to a submersible swimming pool vacuum head, and wherein the bag is specifically structured to provide greater circulation at a top portion of the collection chamber of the bag to achieve a self-cleaning action, and wherein the bag is further structured and disposed to provide a low pressure area towards the bottom of the collection chamber for gathering collected debris without falling out through the open end of the collection bag.

It is a further object of the present invention to provide an improved collection bag for a self-contained swimming pool vacuum head which includes a cone shaped entry portion at the open end of the bag for increasing thrust pressure into the bag during operation of the swimming pool vacuum head.

It is still a further object of the present invention to provide an improved collection bag for self contained swimming pool vacuum heads which provides greater circulation at a top of the collection chamber of the bag for creating a self-cleaning action, low pressure near the bottom of the bag for gathering debris without exiting the open end of the bag, and increased thrust pressure through a cone shaped entry of the bag, and further wherein the collection bag is made of a unitary construction with an easy to operate releasably lockable cinch cord for holding the bag on the vacuum head.

It is a further object of the present invention to provide an improved collection bag for self-contained swimming pool vacuum head, as described above, which is easy to manufacture and which can be provided to the end user at an affordable cost.

It is still a further object of the present invention to provide an improved collection bag for self-contained swimming pool vacuum heads which is easy to remove, clean and reattach to the vacuum head.

These and other objects and advantages of the present invention are more readily apparent with reference to the detailed description and accompanying drawings.

SUMMARY OF THE INVENTION

The present invention is directed to a debris collection bag for removable attachment to a self-contained swimming pool vacuum head of the type that has a motor driven propeller to generate thrust for picking up debris and forcing the debris into the collection bag. The collection bag is made of a water permeable material and includes a main upper portion that encloses a collection chamber and a truncated lower portion with a lower end. A sleeve between the upper and lower portions surrounds the bag and contains a releasable cinch cord for securing the bag over an annular rim on the vacuum head. The truncated lower portion tucks upwardly within the collection chamber to provide a frustoconical intake that increases thrust pressure entering the bag, while providing greater self cleaning circulation at the top of the collection chamber and a low pressure area surrounding the truncated lower portion to allow leaves, dirt and other debris to settle without escaping the collection chamber.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to the several view of the drawings, the collection bag of the present invention is shown and is generally indicated as 10.

Figure 2:
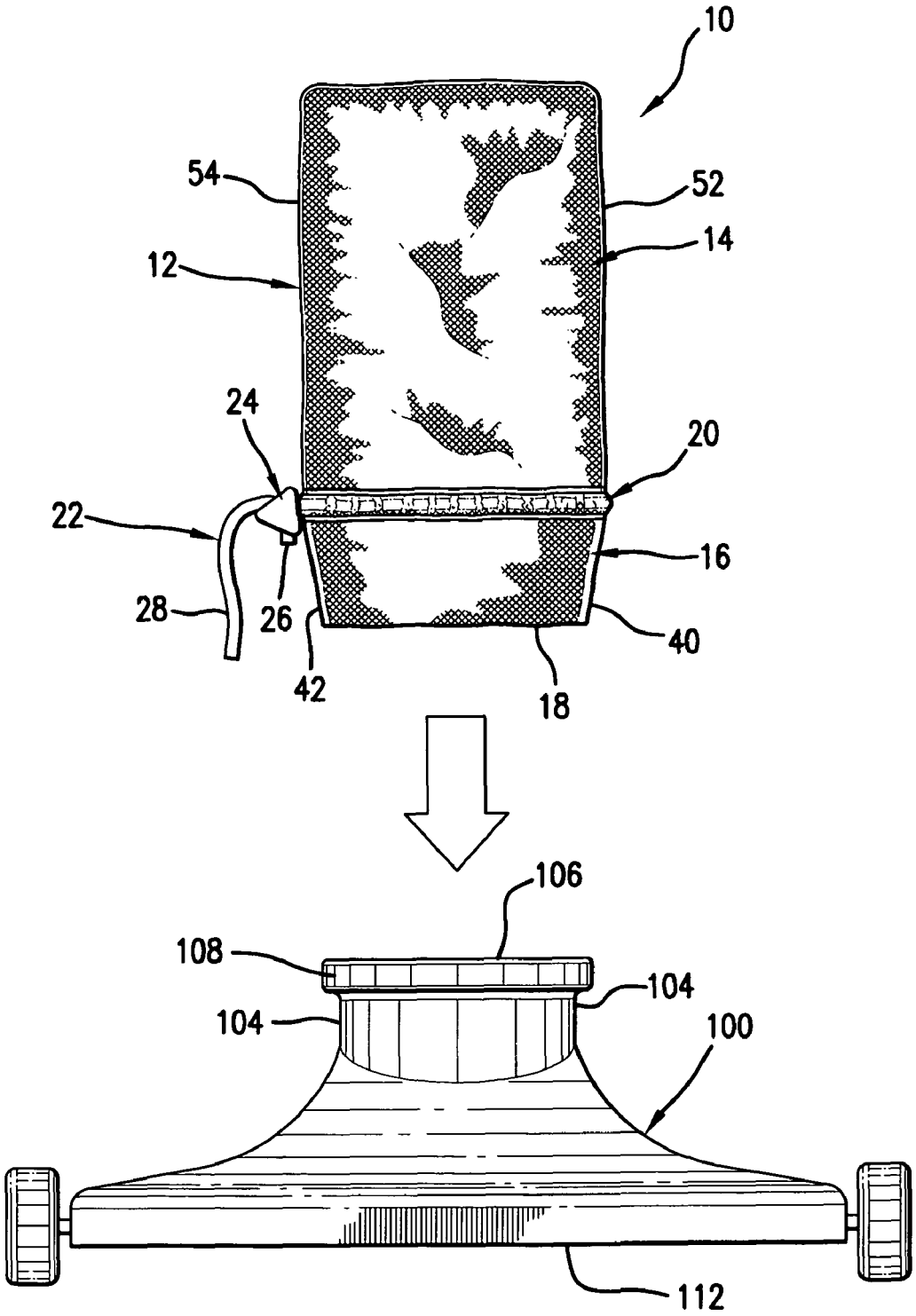
FIG. 2 is a front elevational view showing the debris collection bag of the present invention separated from a self-contained swimming pool vacuum head.
Figure 3:
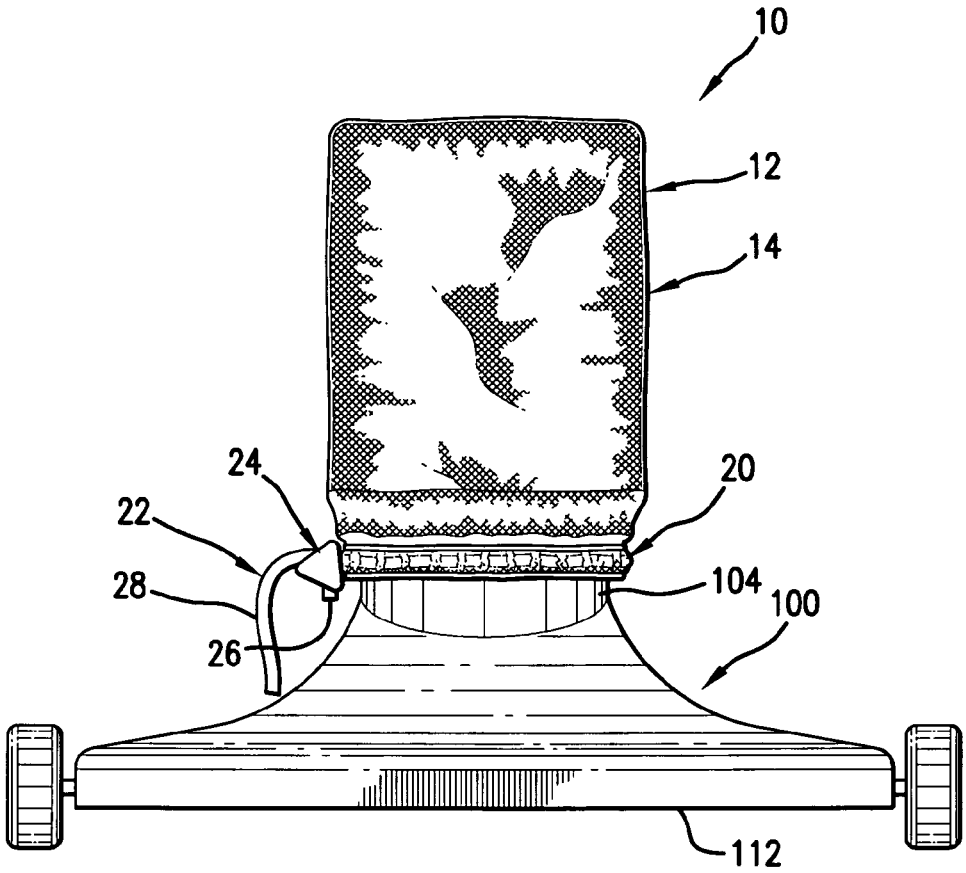
FIG. 3 is a front elevational view showing the debris collection bag secured to the discharge opening at the top of the thrust channel of the self-contained swimming pool vacuum head.
Figure 4:
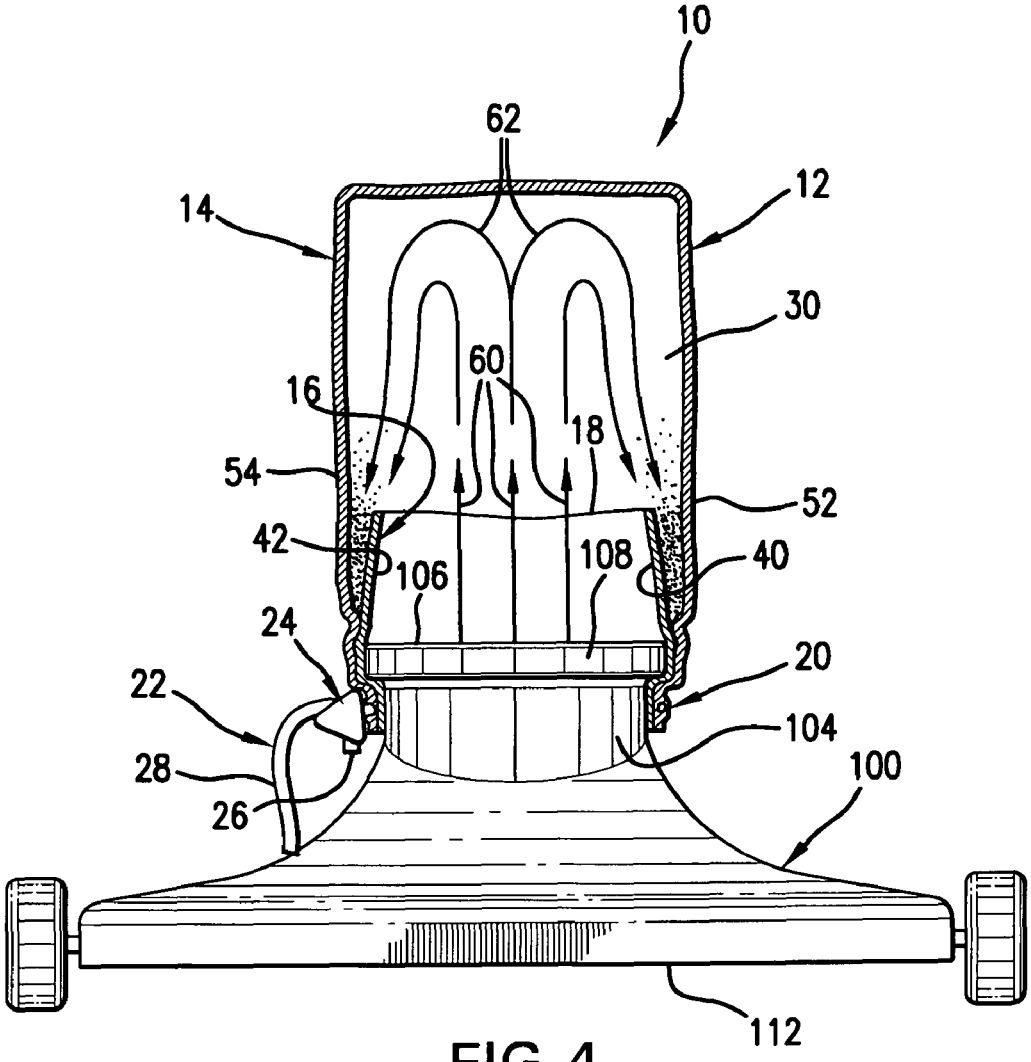
FIG. 4 is a front elevational view in partial cross-section, showing the debris collection bag attached to the vacuum head and illustrating the direction of thrust and circulation within the interior collection chamber of the bag to create a high pressure area at the entry into the bag, the high circulation self-cleaning area at the top of the collection chamber and a low pressure debris collection area surrounding a lower frustoconical portion of the collection bag for trapping the collected debris within the collection chamber.

The collection bag 10 includes a main body 12 with an upper portion 14 and a lower truncated portion 16 that has an open end 18. A sleeve 20 surrounds the bag, between the upper and lower portions, for holding a cinch cord 22 that extends through the sleeve with opposite end segments 26, 28 of the cord remaining exterior of the sleeve. A locking device 24 is fixed to one end portion 26 of the cinch cord 22. The opposite end segment 28 of the cinch cord 22 is moveable relative to the locking device 24 to tighten and loosen attachment of the bag 10 over a self-contained swimming pool vacuum head 100, as shown in FIGS. 2-4. More particularly, by pulling on the second end segment 28 of the cinch cord, the sleeve 20 is pulled inwardly relative to an interior of the bag causing the sleeve to gather upon itself while tightening the sleeve area relative to the upper portion of the vacuum head that is received within the interior of the bag.

Referring to FIGS. 2-4, the bag 10 is attached to the swimming pool vacuum head 100 by inverting the bag so that the open end 18 faces downwardly towards a top opening 106 of the vacuum head. The lower truncated portion 16 is then tucked into the bag so that it is directed upwardly within an interior collection chamber 30 of the bag 10. The bag is then slipped over an annular rim 108 surrounding the open top discharge port 106 of vacuum head 100, and with the sleeve 20 and cinch cord 22 positioned below the annular rim 108 of the vacuum head, the second end segment 28 of the cinch cord is pulled until the sleeve 20 is fitted tightly around the neck 104 of the vacuum head, just below the annular rim 108. The second end segment 28 of the cinch cord 22 is then locked into fixed position by pulling at an angle relative to the lock device 24. More specifically, the lock device 24, which is of a conventional type, allows the second end segment 28 of the cinch cord to be releasably locked in position to thereby hold the bag 10 on the vacuum head 100 so it cannot be pulled upwardly over the annular rim 108.

Accordingly, during operation of the vacuum head 100, a motor driven propeller within the vacuum head creates an upward thrust to pull debris up through the bottom mouth 112 of the vacuum head and into the collection chamber 30.

Figure 1:
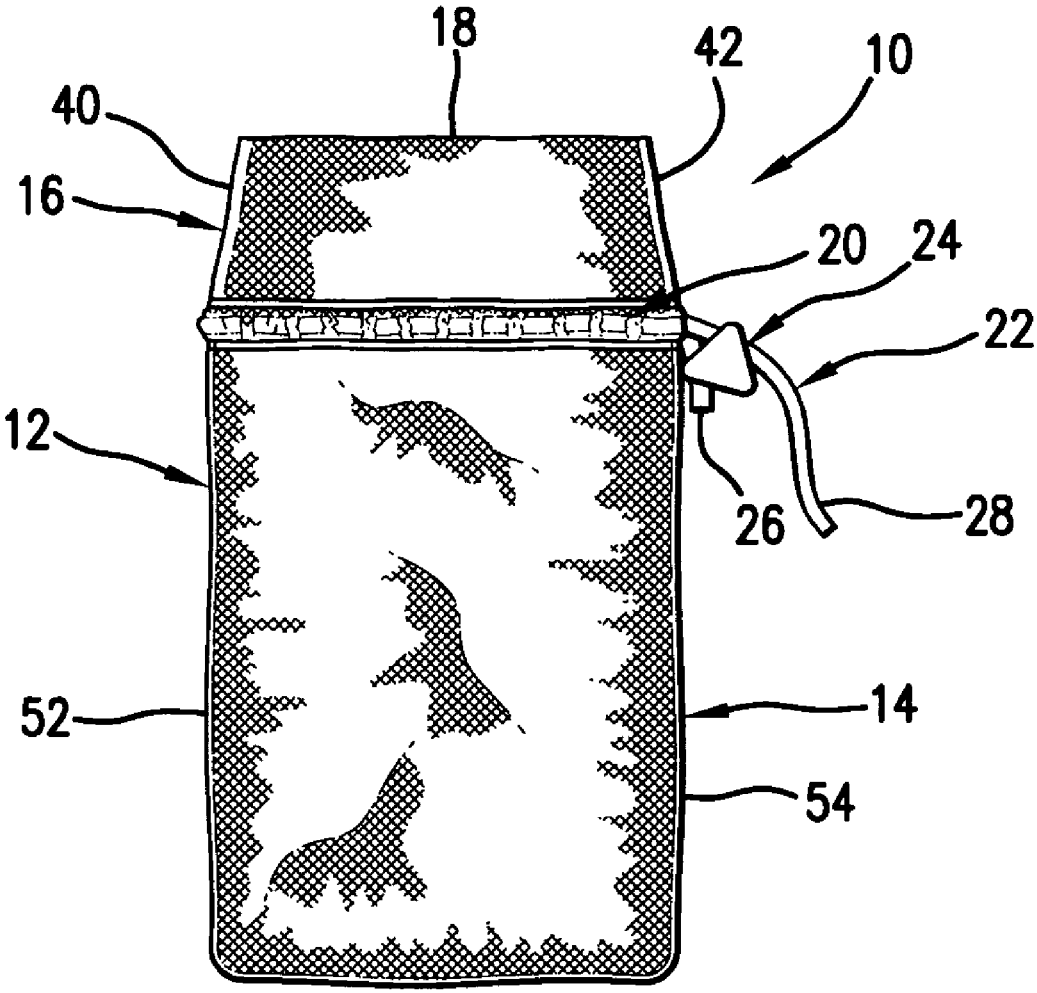
FIG. 1 is a side elevational view of the debris collection bag of the present invention.

An important feature of the debris collection bag 10 of the present invention is the lower truncated portion 16. As seen in FIGS. 1 and 2, the lower truncated portion extends from the sleeve 20 and has opposite edges 40, 42 that are tapered inwardly and downwardly to the open end 18 so that the open end is smaller in transverse dimension as compared to the transverse dimension of the upper portion 14 of the bag 10 measured between opposite sides 52, 54. More particularly, the straight line distance measured across the mouth of the open end 18 is smaller than the straight line distance measured transversely across the interior collection chamber 30, between the opposite sides 52, 54, as seen in FIG. 4. When the bag is attached to the vacuum head, and the lower truncated portion 16 is tucked upwardly into the collection chamber 30, as seen in FIG. 4, the lower truncated portion 16 forms a frustoconical intake nozzle that increases thrust pressure entering into the bag, as indicated by the arrows 60 in FIG. 4. This increased thrust pressure creates a swirling circulation at the top of the interior collection chamber 30, as indicated by the arrows 62 in FIG. 4. The swirling, active circulation provides a self-cleaning action that discourages debris (i.e., leaves, bugs, etc.) from gathering at the upper area of the collection chamber 30. The swirling circulation within the interior chamber directs the collected debris towards low pressure areas surrounding the truncated portion 16 at the lower portion of the collection chamber 30. Accordingly, as shown in FIG. 4, collected debris tends to settle in these lower pressure areas, becoming trapped between the truncated portion 16 and the sidewalls of the upper portion 14 of the bag. The debris collects in these low pressure areas surrounding the truncated portion 16, preventing the debris from escaping out of the open end of the bag.

While the present invention has been shown and described in accordance with a preferred and practical embodiment thereof, it is recognized that departures from the instant disclosure are contemplated within the spirit and scope of the present invention, which is not to be limited, except as defined in the following claims as interpreted under the Doctrine of Equivalents.

What is claimed is:

1. A debris collection bag for attachment over an open discharge port of a self-contained swimming pool vacuum head, said debris collection bag comprising:

a main body formed of a water permeable material and including an upper portion having a closed top end and closed sides surrounding an interior collection chamber and a lower portion including an open end communicating with said interior collection chamber;

a sleeve attached to said main body of said bag and surrounding said main body between said upper portion and said lower portion;

a cinch cord extending through said sleeve and having a first end segment and an opposite second end segment extending exteriorly of the sleeve;

a locking device structured and disposed for releasably securing said first and second end segments of said cinch cord relative to one another, wherein at least one of said first and second end segments is adapted to be released from said locking device and pulled away from said sleeve to cause said sleeve to close around the vacuum head and said locking device being structured and disposed to releasably lock said first and second opposite end segments of said cinch cord in fixed position to hold said bag on said vacuum head;

said lower portion of said body of said bag tapering inwardly from said sleeve to said open end so that a transverse dimension of said open end is less than a transverse dimension measured across said interior collection chamber; and said lower portion being structured and disposed to be tucked upwardly into said interior collection chamber of said upper portion of said main body to define a frustoconical intake nozzle, and said frustoconical intake nozzle being structured and disposed for increasing thrust force of a forced flow of water exiting said discharge port of said vacuum head and entering said interior collection chamber, and said frustoconical intake nozzle of said bag being further structured and disposed for promoting circulation of said forced flow of water at an upper portion of said interior collection chamber and creating a low pressure area within said interior collection chamber surrounding said frustoconical intake nozzle for collecting debris between said frustoconical intake nozzle and said surrounding sides of said upper portion of said main body of said bag.

2. A debris collection bag for attachment over an open discharge port of a self-contained swimming pool vacuum head, said debris collection bag comprising:

a main body formed of a water permeable material and having a closed top end and closed sides surrounding an interior collection chamber and a lower end;

a cinch cord extending about said lower end of said main body for releasably securing said lower end about the open discharge port in order to hold the debris collection bag on the vacuum head;

a frustoconical intake nozzle extending upwardly from said lower end of said main body and within said interior collection chamber, and said frustoconical intake nozzle having an open nozzle end positioned within said interior collection chamber and communicating with the open discharge port of the vacuum head, and said frustoconical intake nozzle being structured and disposed for increasing thrust force of a forced flow of water exiting the discharge port of the vacuum head and entering said interior collection chamber.

3. The debris collection bag as recited in claim 2 wherein said frustoconical intake nozzle is integrally formed with said main body.

4. The debris collection bag as recited in claim 3 wherein said frustoconical intake nozzle extends from said lower end of said main body and is structured and disposed to be tucked upwardly into said interior collection chamber.

5. The debris collection bag as recited in claim 4 wherein said frustoconical intake nozzle is structured and disposed for promoting circulation of the forced flow of water at an upper portion of said interior collection chamber.

6. The debris collection bag as recited in claim 5 wherein said frustoconical intake nozzle and said main body are cooperatively structured and disposed for creating a low pressure area within said interior collection chamber surrounding said frustoconical intake nozzle for collecting debris within a lower portion of said interior collection chamber.

7. The debris collection bag as recited in claim 6 further comprising:

a sleeve formed about said lower end of said main body; and said cinch cord extending through said sleeve.

8. The debris collection bag as recited in claim 7 wherein said cinch cord has a first end segment and an opposite second end segment extending exteriorly of the sleeve.

9. The debris collection bag as recited in claim 8 further comprising:

a locking device structured and disposed for releasably securing said first and second end segments of said cinch cord relative to one another in order to close said lower end of said main body around the open discharge port of the vacuum head, and said locking device being structured and disposed to releasably lock said first and second opposite end segments of said cinch cord in fixed position to hold the debris collection bag on the vacuum head.

* * * * *